United States Patent [19]

Liou

[11] Patent Number: 4,614,001

[45] Date of Patent: Sep. 30, 1986

[54] MULTIPURPOSE PLIER

[76] Inventor: Mou T. Liou, No. 33, Si Fu Road, Ta Li Hsiang, Taichung Hsieng, Taiwan

[21] Appl. No.: 784,257

[22] Filed: Oct. 3, 1985

[51] Int. Cl.[4] ..... B25B 7/22

[52] U.S. Cl. ..... 7/137; 81/405

[58] Field of Search ..... 7/129–134, 7/137, 107; 81/385, 393, 405, 407, 411

[56] References Cited

U.S. PATENT DOCUMENTS

| | | | |
|---|---|---|---|
| 772,574 | 10/1904 | McDowell | 7/137 X |
| 1,227,372 | 5/1917 | Bledsoe | 87/405 |
| 1,293,966 | 2/1919 | Springer | 7/137 X |
| 1,344,114 | 6/1920 | Carlson | 7/137 X |
| 1,823,494 | 9/1931 | Jacobs | 7/137 X |
| 2,572,237 | 10/1951 | Andrews | 7/137 X |

*Primary Examiner*—James G. Smith

*Attorney, Agent, or Firm*—Browdy and Neimark

[57] ABSTRACT

A multipurpose plier which comprises two component parts which are pivoted together and each of which has a handle portion, an intermediate portion and a web portion. The intermediate portions can abut against one another tightly, and curved jaw components, means for stripping wire and cutting means are formed on the intermediate portions. Each web portion is provided with a nosed and toothed portion, and a toothed horn. The nosed and toothed portions cooperate to act as a nosed plier, and the toothed horns function as an open wrench. One of the web portion is further provided with a hammer head and a nail pulling claw.

6 Claims, 4 Drawing Figures

MULTIPURPOSE PLIER

BACKGROUND OF THE INVENTION

This invention relates to a plier, particularly to a multipurpose plier.

Various forms of pliers have existed in the art. One form of pliers is that which includes flat, toothed jaws for holding, clamping, and bending small objects and also a means for cutting small objects, such as wires. Another form of pliers includes curved toothed jaws for holding, and clamping larger pieces. Still other types of pliers have wire stripping means or wire cutting means in combination with flat toothed jaws or curved toothed jaws. The pliers have been constructed in various sizes and various configurations so as to fill the need for various operations.

SUMMARY OF THE INVENTION

It is an object of the invention to provide a multipurpose plier that can perform more functions than can a conventional plier.

This and other objects can be achieved in accordance with the present invention through the provision of a plier which comprises a first component part having a first handle portion, a first intermediate portion, and a first web portion, and a second component part having a second handle portion, a second intermediate portion, and a second web portion. The first web portion includes a circular pivot hole, a first toothed nose portion and a guide piece projecting from one of its sides. The intermediate portion has a first curved jaw component.

The second web portion has an oblong pivot hole extending longitudinally and is pivoted to the first web portion. The second nose portion is toothed and can co-operate with the first nose portion. A guide recess is provided in the second web portion to receive the guide piece of the first web portion, to guide its movement so that the first web portion can move relative to the second web portion between a first position and a second position. The second intermediate portion can abut against the first intermediate portion tightly and has a second curved jaw component to co-operate with the first curved jaw component. The first and second nosed portions cooperate when the first web portion is in the first position, and the first and second curved jaw components cooperate when the first web portion is in the second position. There is a hammer head which is of one piece with the second web portion and which extends from the second web portion.

In one aspect of the invention, the guide recess of the second web portion includes a portion extending longitudinally and two branching portions extending transversely from the two ends of the longitudinal portion.

In another aspect of the invention, the plier further includes means for stripping a wire formed on the first and second intermediate portions.

In a further aspect of the invention, the plier further includes a cutting means formed on said first and second intermediate portion.

In yet further aspect of the invention, the second web portion includes a first horn extending therefrom provided with a nail pulling claw and a rough surface. The first web portion includes a second horn which extends therefrom and is provided with a rough surface to cooperate with the rough surface of the first horn to act as a clamping pair of jaws.

The present exemplary preferred embodiment will be described in detail with reference to the following drawings, in which:

DETAILED DESCRIPTION OF THE PREFERRED EMBODIMENT

Figure 1:
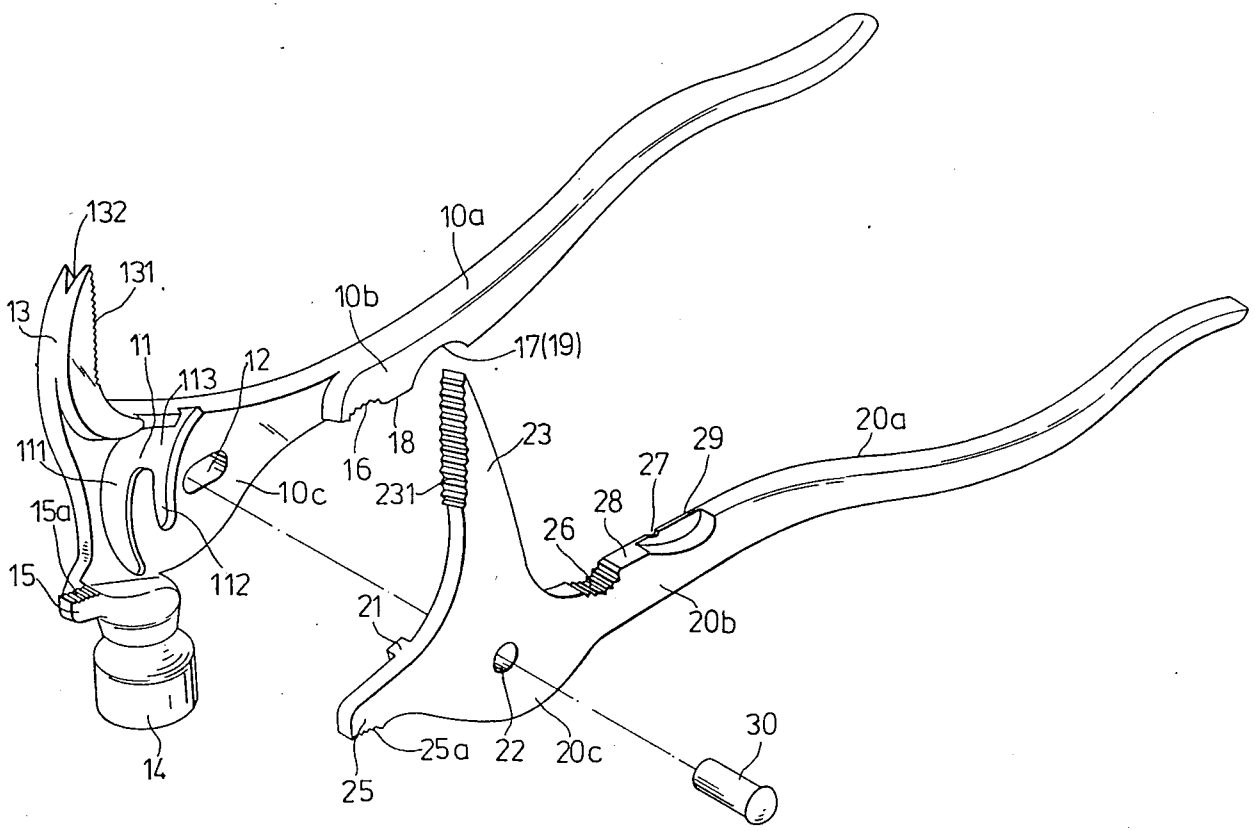
FIG. 1 is an exploded view of the plier according to the present invention.
Figure 2:
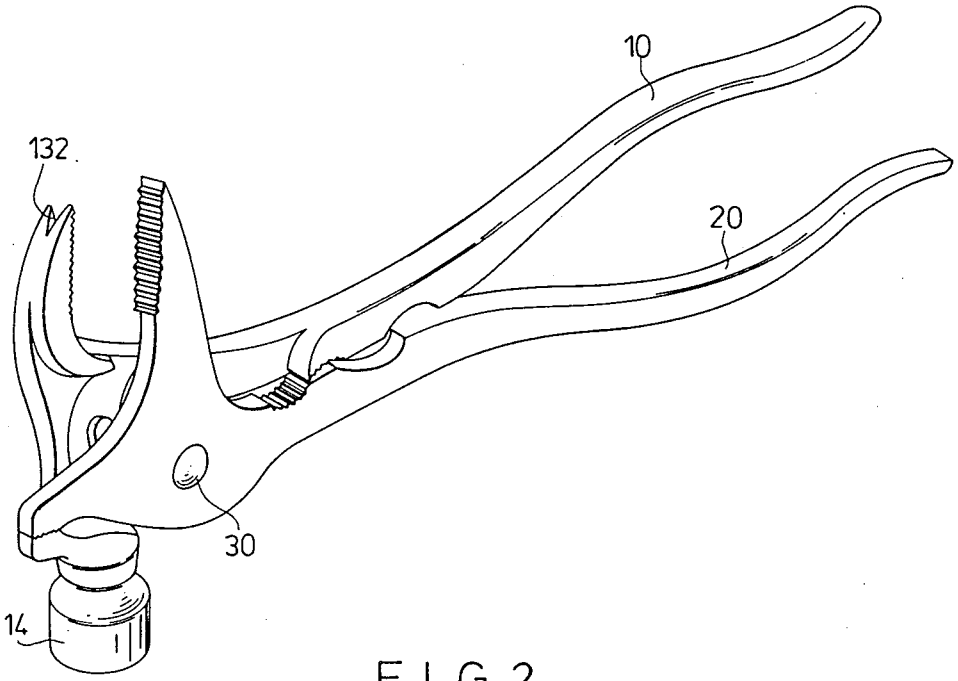
FIG. 2 is a perspective view of a plier of FIG. 1.

Referring to the drawings, there is shown a combined hammer and plier which is comprised of two component parts, one having a handle portion 20*a*, an intermediate portion 20*b* and a web portion 20*c* and the other having a handle portion 10*a*, an intermediate portion 10*b* and a web portion 10*c*.

The web portion 20*c* includes a circular pivot hole 22, a nose portion 25 with a toothed surface 25*a*, a guide piece 21 projecting from the plane of the web portion 20*c*, and a jaw 23 with a toothed surface 231.

The web portion 10*c* is pivoted to the web portion 20*c* with a pivot 30 which passes through the hole 22 and an oblong hole 12 of the web portion 10*c* which extends longitudinally. The web portion 10*c* is provided with a nose portion 15 with a toothed surface 15*a*, a hammer head 14, a horn 13 with a nail pulling claw 132 and a toothed surface 131, and a guide recess 11. The guide recess 11 includes a portion 113 extending longitudinally and two branching portions 111 and 112 extending transversely from the two ends of the portion 113, the branching portions 111 and 112 being slightly curved. The guide recess 11 receives guide piece 21 of the web portion 20*c* to guide its movement so that the web portion 20*c* will move relative to the web portion 10*c* between a first position in which the guide piece 21 is in the branching portion 111 and a second position in which the guide piece 21 is in the branching portion 112.

Figure 3:
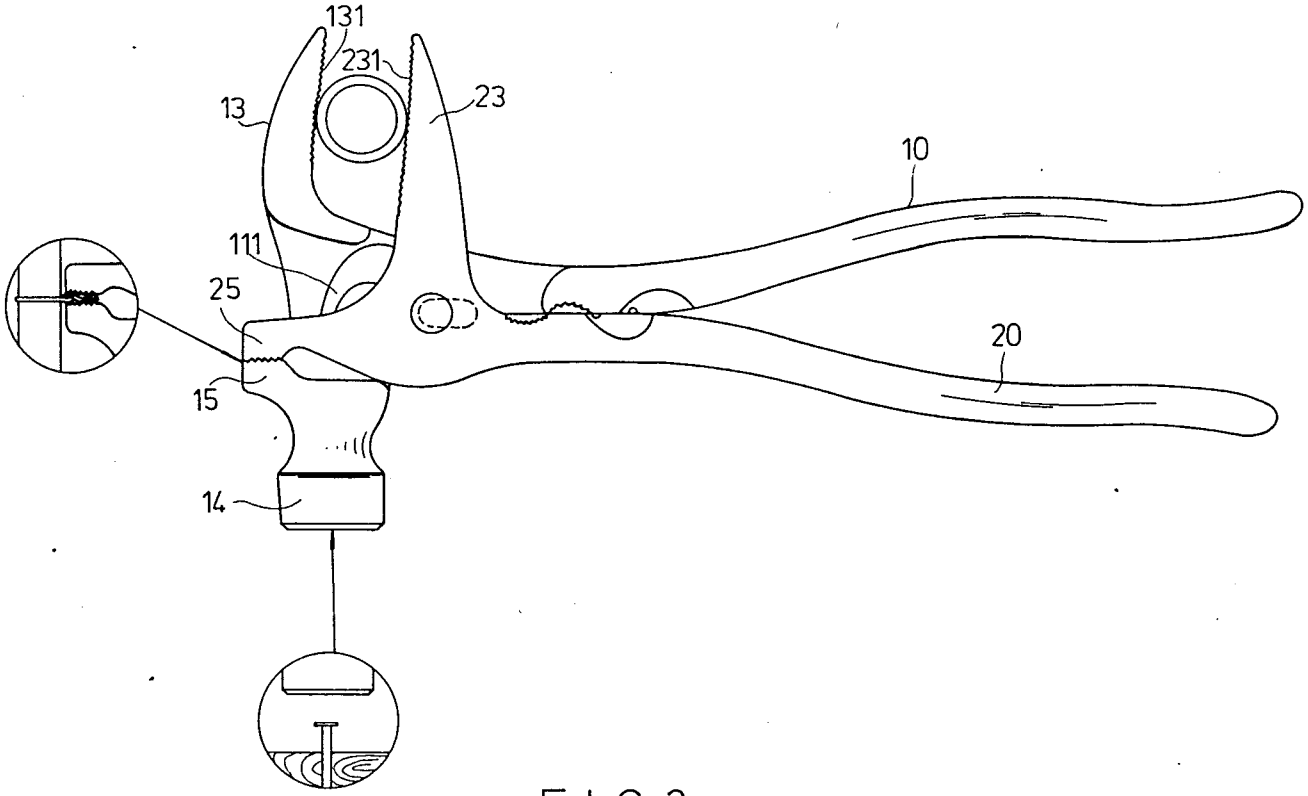
FIG. 3 is an elevational view in which the nosed portions of the plier are in an operative position.

When web portion 20*c* is in the first position, nose portions 15 and 25 cooperate to function as a flat nosed plier, as shown in FIG. 3. Horns 13 and 23 are spaced apart from one another and their toothed surfaces face one another to cooperate as an open wrench or a pipe wrench whenever the web portion 20 is the first position or the second position.

The intermediate portion 20*b* is provided with a component curved jaw formation 26, a flat face 28 and a sharp edge 29 with a curved recess 27. The intermediate portion 10*b* can abut against the intermediate portion 20*b* tightly and is provided with a curved jaw component 16 to cooperate with the curved jaw component 26, a flat face 18 to cooperate with the flat face 28, and a sharp edge 19 with a curved recess 17. The sharp edges 19 and 29 cooperate with one another to act as a cutting means and the curved recesses 17 and 27 can be used as a means for stripping a wire.

Figure 4:
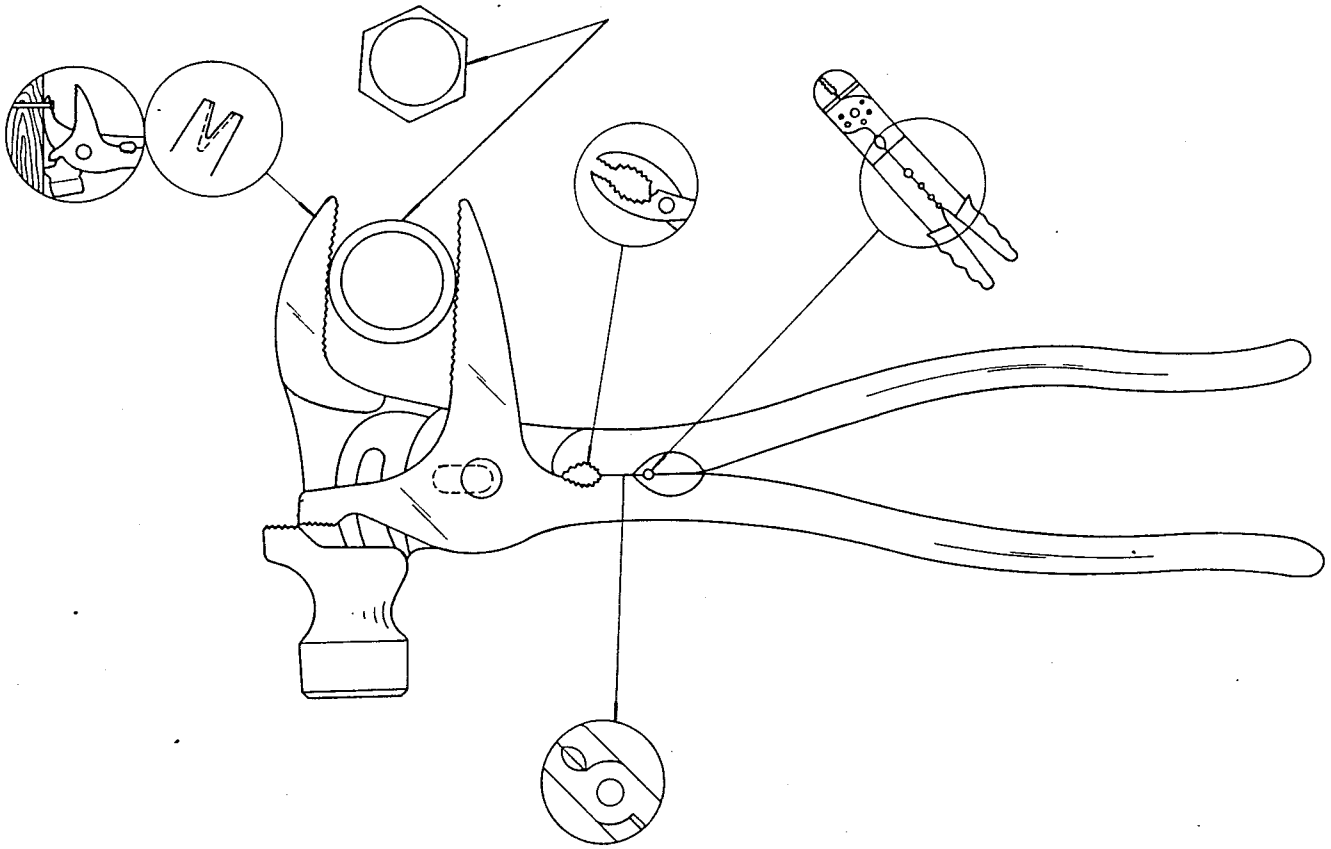
FIG. 4 is an elevation veiw in which the nosed portions of the plier are not operative.

It can be appreciated that the component parts provided on the intermediate portion 10*b* and 20*b* are operative only when the web portion 20*c* is the second position, as shown in FIG. 4. In operation, one may put the web portion 20*c* in the first position or the second position by moving the guide piece 21 in the recess 11 manually as desired.

With the invention thus explained, it is apparent that various modifications and variations can be made without departing from the scope of the present invention. It is therefore intended that the invention be limited as indicated in the appended claims.

What I claim is:

1. A multipurpose plier comprising:

a first component part having a first handle portion, a first intermediate portion, and a first web portion, said web portion having a circular pivot hole having a pivot axis, a first nose portion extending in a direction perpendicular to said axis, and a guide piece projecting in a direction along said axis, said first nose portion being provided with a toothed surface, said intermediate portion having a first curved jaw component;

a second component part including a second handle portion, a second intermediate portion capable of tightly abutting against said first intermediate portion, and a second web portion which is pivoted to said first web portion, said second web portion having a oblong pivot hole extending longitudinally, a second nose portion longer than said first nose portion having a toothed surface to cooperate with said toothed surface of said first nose portion, and a guide recess which receives said guide piece to guide its movement so that said first web portion moves longitudinally relative to said second web portion between a first position and a second position, said second intermediate portion having a second curved jaw component to cooperate with said first jaw component, said first and second nose portions cooperating when said first web portion is in said first position, and said first and second curved jaw component cooperating when said first web portion is in said second position; and a hammer head which is one piece with and extends from said second web portion.

2. A multipurpose plier as claimed n claim 1, wherein said recess of said second web portion includes a portion extending longitudinally and two branching portions extending transversely from the two ends of said portion.

3. A multipurpose plier as claimed in claim 1, further including means for stripping a wire formed on said first and second intermediate portion.

4. A multipurpose plier as claimed in claim 1, further including a cutting means formed on said first and second intermediate portion.

5. A multipurpose plier as claimed in claim 1, wherein said second web portion includes a first horn extending therefrom in the opposite direction relative to said hammer head, said first horn having a nail pulling claw and a rough surface.

6. A multipurpose plier as claimed in claim 4, wherein said first web portion includes a second horn which extends therefrom and is provided with a rough surface, the rough surface of said second horn being spaced apart from and facing the rough surface of said first horn to cooperate with it to act as a clamping jaw.

* * * * *